United States Patent [19]

Zarogatsky et al.

[11] 4,452,401

[45] Jun. 5, 1984

[54] INERTIA CONE CRUSHER

[76] Inventors: Leonid P. Zarogatsky, Uglovoi pereulok, 5, kv. 21; Boris G. Ivanov, Basseinaya ulitsa, 5, kv. 8; Nikolai A. Ivanov, Novoizmailovsky prospekt, 19, kv. 96; Evgeny S. Mitrofanov, ulitsa Kibalchicha, 4, korpus 1, kv. 17; Andrei N. Safronov, ulitsa Korablestroitelei, 19, korpus 1, kv. 728; Vladimir Y. Turkin, Novoizmailovsky prospekt, 19, kv. 94; Vladimir A. Cherkassky, ulitsa Rudneva, 3, korpus 1, kv. 38, all of Leningrad, U.S.S.R.

[21] Appl. No.: 298,012

[22] Filed: Aug. 31, 1981

[51] Int. Cl.[3] ..... B02C 2/04

[52] U.S. Cl. ..... 241/207; 241/210

[58] Field of Search ..... 241/207, 210, 211, 212, 241/213, 216

[56] References Cited

U.S. PATENT DOCUMENTS

| | | | |
|---|---|---|---|
| 464,463 | 12/1891 | McCully | 241/213 |
| 1,549,555 | 8/1925 | Jorgensen | 241/216 X |
| 4,073,446 | 2/1978 | Rundkuist et al. | 241/210 X |
| 4,245,791 | 1/1981 | Ivanov | 241/207 |

FOREIGN PATENT DOCUMENTS

| | | | |
|---|---|---|---|
| 419240 | 8/1974 | U.S.S.R. . | |
| 715133 | 2/1980 | U.S.S.R. | 241/207 |
| 737011 | 6/1980 | U.S.S.R. | 241/207 |
| 762966 | 9/1980 | U.S.S.R. | 241/207 |
| 814445 | 3/1981 | U.S.S.R. | 241/210 |

*Primary Examiner*—Mark Rosenbaum

*Attorney, Agent, or Firm*—Murray Schaffer

[57] ABSTRACT

An inertia cone crusher having a shell installed via elastic shock-absorbers on a base is provided with a crushing bowl, and a breaking head having a shaft mounted on a spherical support. An out-of-balance unit formed as a bearing bush is provided with an out-of-balance weight and a carrier disc and is installed on the shaft of the breaking head. A rod for mounting the out-of-balance unit on the breaking head has its lower end installed on the bearing bush. The upper end of the rod is installed in a bore of the shaft shank with a mounting clearance with respect to the rod end face and the out-of-balance unit is liftable and fixable in its upper position.

21 Claims, 11 Drawing Figures

INERTIA CONE CRUSHER

FIELD OF THE INVENTION

The present invention generally relates to material crushing, and particularly to inertia cone crushers.

Most successfully, the present invention can be used in the mining and dressing, chemical and construction industries.

BACKGROUND OF THE INVENTION

The inertia cone crushers now in use comprise a crushing bowl accommodating a breaking head therein to form an annular crushing space therebetween. The breaking head is installed on a spherical support fastened to the crusher shell like the crushing bowl. The shaft of the breaking head is arranged within a bearing bush carrying an out-of-balance weight on its outer surface. The bush is linked with a drive arranged in the lower portion of the crusher by means of a flexible transmission.

The installation height of inertia crushers is determined by the length of the flexible transmission which is the principal assembly of the crusher defining the complexity of its construction, the labor input in service and the cost of construction of the structures used to install the crusher.

During the crusher operation the liner mounted on the crusher breaking head is worn and requires replacement. Due to the construction features of the crusher the breaking head must be removed at the repair site in order to replace the liner. This operation in conjunction with further re-installation of the breaking head into the crusher is complicated by the flexible coupling of the bush with the drive and the necessity to fix the bush in a position as close as possible coaxially with the crusher shell.

Known in the prior art is an inertia cone crusher (cf. USSR Author's Certificate No. 596 280,) comprising a shell installed through elastic shock-absorbers on a base and having a crushing bowl, a breaking head with a shaft mounted on a spherical support made in the shell, an out-of-balance unit made as a bearing bush provided with an out-of-balance weight, installed on the shaft of the breaking head and connected by means of a flexible transmission with a drive rigidly fixed on the base.

In this construction the flexible transmission is made as a ball spindle being both a driving member and a support for the out-of-balance unit. The spherical tips of the spindle are provided with sockets having balls installed therein and are arranged in slit bores of the bearing bush and of the drive.

The articulated joints of the transmissions used do not provide the vertical position of the bush when the breaking head is dismantled, therefore before its dismantling the bush is placed coaxially with the shell axis by means of saddles placed under the out-of-balance weight which are removed from the crusher after the breaking head is reinstalled. This operation is time and labor-consuming. The spindle and the slots for the tips thereof are complex and require a high degree of accuracy in their manufacture, making the construction of the machine as a whole more expensive.

The operation of the spindle as a driving member and a support for the out-of-balance unit reduces its life and the reliability of the drive to which the axial load is transmitted.

Furthermore, connection of the out-of-balance unit with the drive by a single spindle increases the height of installation since it is necessary to organize a complicated oil and dust sealing between the movable shell and its base.

Also known in the prior art is an inertia cone crusher (cf. USSR Author's Certificate No. 632 388,) comprising a shell installed through elastic shock-absorbers on a base and having a crushing bowl, a breaking head with a shaft mounted on a spherical support made in the shell, an out-of-balance unit made as a bearing bush provided with an out-of-balance weight, installed on the shaft of the breaking head and linked by means of a flexible transmission with a drive rigidly fixed on the base.

In this crusher the flexible transmission is made as a ball spindle connecting the bearing bush with an intermediate shaft journaled in shell bearings and linked by its lower end with the drive by means of a second ball spindle or an elastic compensation clutch.

Like in the previous analogue, the upper ball spindle serves to function both as a driving member and a support for the out-of-balance unit; however, here it transfers the axial load through the bearings of the intermediate shaft to the shell. This increases the life of the drive, but complicates the construction and increases the production cost of the machine since new additional members—the intermediate shaft with bearings and the additional spindle or the clutch—are introduced into the transission.

The members introduced additionally into the transmission increase still more the installation height of the crusher as compared with the previous crusher and do not simplify the dismantling and re-installation of the breaking head.

Also known is an inertia cone crusher (cf. USSR Author's Certificate No. 419 240).

This crusher comprises a shell installed through elastic shock-absorbers on a base and having a crushing cone, a breaking head with a shaft mounted on a spherical support made in the shell, an out-of-balance unit made as a bearing bush installed on the breaking head shaft and provided with an out-of-balance weight and a carrier disc, a rod used for mounting said out-of-balance unit on the breaking head and having its lower end mounted in the bearing bush, and a means for mounting the upper end of the rod in an upper portion of the breaking head.

As distinguished from the previous constructions, mounting of the out-of-balance unit in this crusher on the breaking head allows to the elimination of the axial load acting on the flexible transmission and driving member. This improves the reliability of the transmission. However, since the upper end of the rod is fastened to the upper portion of the breaking head, the dismantling of the latter is substantially complicated by the fact that it is first necessary to disassemble its liner fastening in order to provide access to the rod fastening assembly. This is a very labor-consuming operation, especially for industrial large-size crushers. Large crusher installation height, complexity of the construction and the labor-consuming operations for the breaking head liner replacement involve the same difficulties as in the previously discussed crushers.

SUMMARY OF THE INVENTION

It is an object of the present invention to provide an inertia cone crusher that would reduce the labor input when dismantling and re-installing the breaking head.

Another object of the present invention is to provide an inertia cone crusher that would reduce the waste of time in dismantling and re-installing the breaking head.

Still another object of the present invention is to provide an inertia cone crusher simple in design.

A further object of the present invention is to provide an inertia cone crusher that would reduce the installation height of the crusher.

With these and other objects in view there is proposed an inertia cone crusher comprising a shell installed through elastic shock-absorbers on a base and having a crushing bowl, a breaking head with a shaft mounted on a spherical support made in the shell, an out-of-balance unit made as a bearing bush installed on the shaft of the breaking head and provided with an out-of-balance weight and a carrier disc, a rod for mounting the out-of-balance unit on the breaking head, having its lower end mounted in the bearing bush, and a means for mounting the upper end of the rod on the breaking head. In accordance with the present invention, the means for mounting the upper end of the rod is installed in a bore made in a shank of the shaft with a mounting clearance with respect to an end face of the rod whereas the out-of-balance unit has a means for lifting it within the mounting clearance and for fixing it in the upper position.

The advantage of the inertia cone crusher proposed stems from the reduction in the labor input required for removal and re-installation of the breaking head owing to the simplified disconnection of the out-of-balance unit from the breaking head shaft. Simultaneously, time losses are reduced during the operation of the inertia cone crusher, its construction is simplified and the installation height is decreased.

According to one embodiment of the inertia cone crusher, the means for mounting the upper end of the rod is made as an annular shoulder supported by a self-aligning end thrust bearing fixed in the bore.

Such an embodiment simplifies its construction and provides the reliable mounting of the breaking head. Furthermore, the installation height of the inertia cone crusher is reduced owing to mounting and fixation of the end thrust bearing in the bore of the shaft shank.

According to another embodiment of the inertia cone crusher, the means for mounting the upper end of the rod comprises a T-shaped gripper made in the bore of the shaft shank of the breaking head and articulated with the associated slot made in the upper end of the rod.

Such an implementation allows the out-of-balance unit to be disconnected from the breaking head without the use of manual labor and waste of time only by rotary motions of the breaking head during its removal from the crusher.

It is advisable that the means for lifting the out-of-balance unit be made as pushers installed in a lower portion of the shell and arranged uniformity along a circumference concentric with the crusher axis.

Such an embodiment for lifting the out-of-balance unit allows it to be moved vertically by a force uniformly distributed along a circumference. This eliminates substantial deviation of the bush axis from its initial position in the vertical plane and provides convenient conditions for mounting the breaking head.

It is also advisable to make shell shock-absorbers as pneumatic balloons and to arrange struts under said pushers so that the pushers would bear against said struts when the shell is set on the pneumatic balloons.

Such an implementation of the shock-absorbers and the shell base allows the construction of the pushers to be simplified and eliminates individual out-of-balance unit lifting mechanisms in each pusher.

It is advisable to complete the pneumatic balloons with a replenishment means.

Such a means permits the lifting of the crusher with respect to the base by supplying air into the pneumatic balloons and to permit its return to the initial position after mounting of the breaking head without the use of manual labor to supply additional air into the balloons.

Simultaneously, said means allows possible air leakages from the pneumatic balloons to be compensated for during the crusher operation.

It is also advisable to make the means for lifting and fixing the out-of-balance unit as lifting jacks installed on the shell base, and to mount an oil defecting ring in the upper portion of the out-of-balance unit.

The implementation of an oil deflecting ring simplifies the construction of the inertia cone crusher by making its shell without movable pushers and by locating the oil casing above the out-of-balance unit. This additionally simplifies the operation of the crusher owing to the convenient access to the out-of-balance unit. Furthermore, the crusher installation height is reduced.

It is also advisable to make spherical a lower surface of the oil deflecting ring projecting beyond the out-of-balance weight, with a center coinciding with the center of the spherical support of the breaking head and provided with an end-face seal arranged concentrically with the crusher axis.

Such an implementation of the oil deflecting ring provides a reliable sealing of the crusher casing and prevents oil leakages and ingress of dust thereinto as the out-of-balance unit is rotating and vibrating with a variable amplitude.

It is further advisable to mount the oil deflecting ring on the bearing bush by means of a bearing.

Such a ring installation allows the reliability of the end-face seal to be improved since it prevents rotation of the ring relative to the seal.

Other and further objects and advantages of the invention will be better understood from the following description taken in conjunction with the accompanying drawings illustrating preferred embodiments of the invention, wherein.

DETAILED DESCRIPTION OF THE INVENTION

Figure 1:
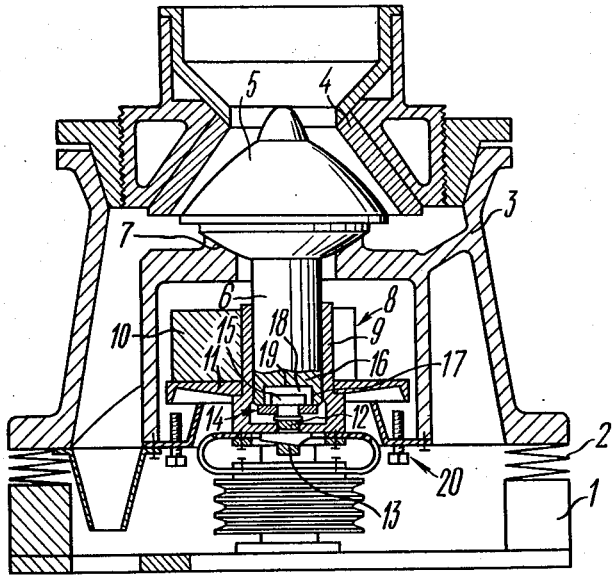
FIG. 1 is a longitudinal sectional view of the inertia cone crusher made in accordance with the present invention.
Figure 2:
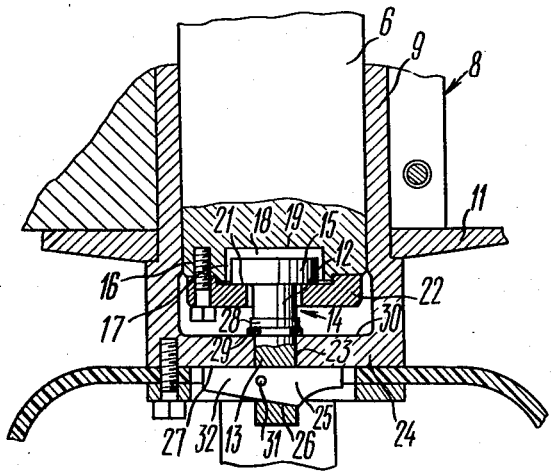
FIG. 2 shows connection of the breaking head with the bearing bush of the out-of-balance unit.

Referring now to the appended drawings and first of all to FIG. 1, the inertia cone crusher made in accordance with the present invention comprises a shell 3 installed through elastic shock-absorbers 2 on a base 1 and having a crushing bowl 4, a breaking head 5 with a shaft 6 installed on a spherical support 7 made in the shell 3, an out-of-balance unit 8 made as a bearing bush 9 installed on the shaft 6 of the breaking head 5 and provided with an out-of-balance weight 10 and a carrier disc 11. Furthermore, the crusher incorporates a rod 12 (FIGS. 1, 2) for mounting the out-of-balance unit 8 on the breaking head 5, having its lower end 13 mounted in the bearing bush 9, and a means 14 for mounting an upper end 15 of the rod 12 on the breaking head 5.

The means 14 for mounting the upper end 15 of the rod 12 is installed in a bore 17 of a shank 16 (FIG. 2) of the shaft 6 with a mounting clearance 18 with respect to a rod end-face 19. The out-of-balance unit 8 (FIG. 1) has a means 20 for lifting it within the mounting clearance 18 and for fixing it in the upper position. The upper end 15 (FIG. 2) of the rod 12 is installed on an end thrust bearing 21 a race 22 secured in the bore 17. The lower end 13 of the rod 12 is arranged with the slide fit in a central hole 23 of a bottom 24 of the bearing bush 9 and fastened thereto by means of a wedge 25 inserted in a slot 26 of the lower end 13 of the rod 12 and bearing against the lower surface of the bottom 24 of the bearing bush 9 by its upper end face 27. The rod 12 is provided with an annular projection 28 and an elastic compensation seal 29 arranged between the annular projection 28 and the an upper surface 30 of the bottom 24 of the bearing bush 9. A center 31 of gravity of the wedge 25 is located outside the axis of the rod 12 on a penetrating portion 32 of the wedge 25.

Figure 3:
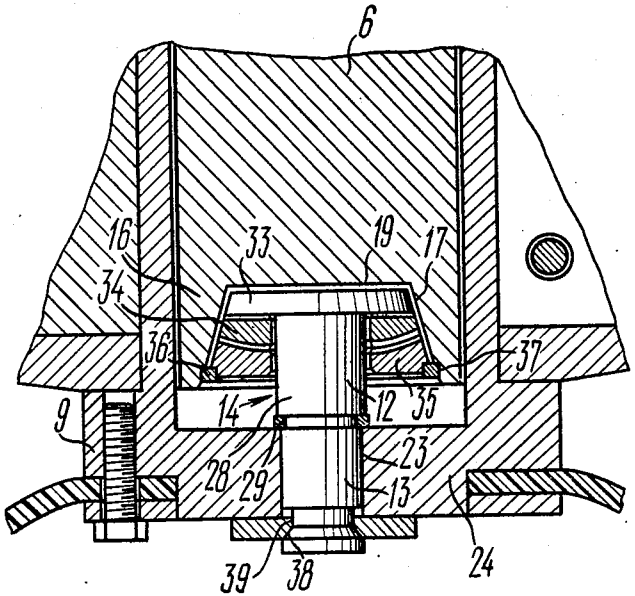
FIG. 3 shows the means for mounting the upper end of the rod in accordance with one embodiment of the present invention.

Referring now to FIG. 3, the means 14 for mounting the upper end 15 of the rod 12 is made as an annular shoulder 33 supported by a self-aligning end thrust bearing 34 arranged on a carrier ring 35 and fixed by a spring washer 36. The spring washer 36 is installed in an annular groove 37 of the bore 17 of the shank 16 of the shaft 6. The lower end 13 of the rod 12 is fastened to the bearing 9 by a radially-movable split ring 38 having an inner tapered edge installed in a tapered annular groove 39 of the lower end 13 of the rod 12.

Figure 4:
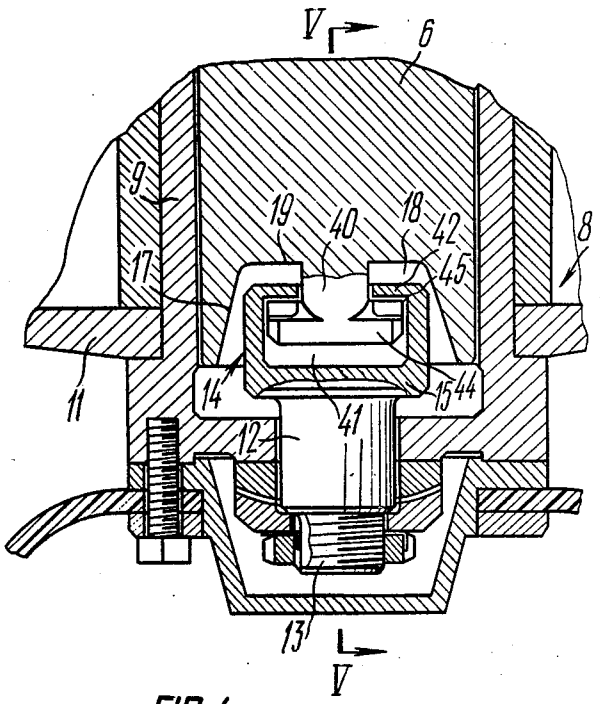
FIG. 4 shows the means for mounting the upper end of the rod in accordance with another embodiment of the present invention.

Referring now to FIG. 4, the means 14 for mounting the upper end 15 of the rod 12 comprises a T-shaped gripper 40 (FIGS. 4, 5) made in the bore 17 and articulated with an associated slot 41 made in the upper end 15 of the rod 12. The slot 41 is provided with a cover 42 having a diametral slit 43 to pass a lower end 44 of the T-shaped gripper 40 into the slot 41. Made at the lower surface of the cover 42 of the slot 41 at right angles to the slit 43 is a groove 45 where the lower end 44 of the T-shaped gripper 40 is accommodated.

Figure 6:
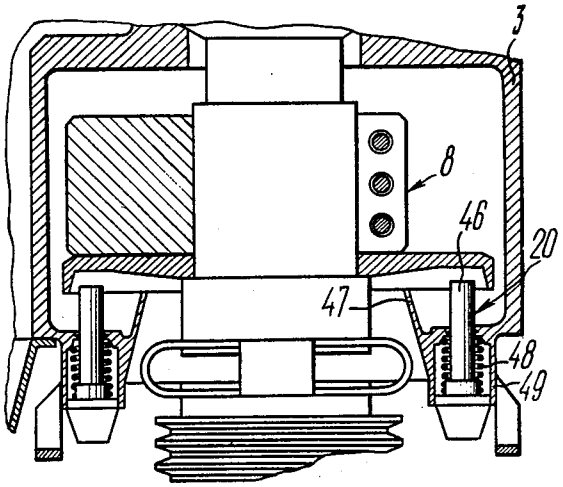
FIG. 6 shows an embodiment of the means for lifting and fixing the out-of-balance unit, made in form of pushers.

FIG. 6 represents an embodiment of the means 20 for lifting and fixing the out-of-balance unit 8. In accordance with this embodiment the means 20 is made as pushers 46 installed in a lower portion 47 of the shell 3 and arranged uniformly along a circumference concentrical with the crusher axis. The pushers 46 are equipped with pressed-out springs 48 and are mounted in cylindrical guides 49 in the lower portion 47 of the shell 3.

Figure 7:
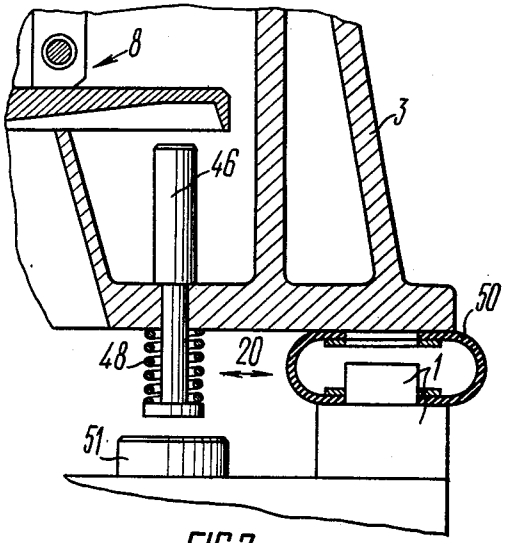
FIG. 7 shows an embodiment of the means for lifting and fixing the out-of-balance unit, provided with pneumatic balloons.

Referring to FIG. 7, the shock-absorbers 2 of the shell 3 can be made as pneumatic balloons 50, struts 51 being arranged under the pushers 46 on the base 1 of the shell 3 and being installed so that the pushers 46 would bear against the struts 51 when the shell 3 sets on the pneumatic balloons 50.

Figure 8:
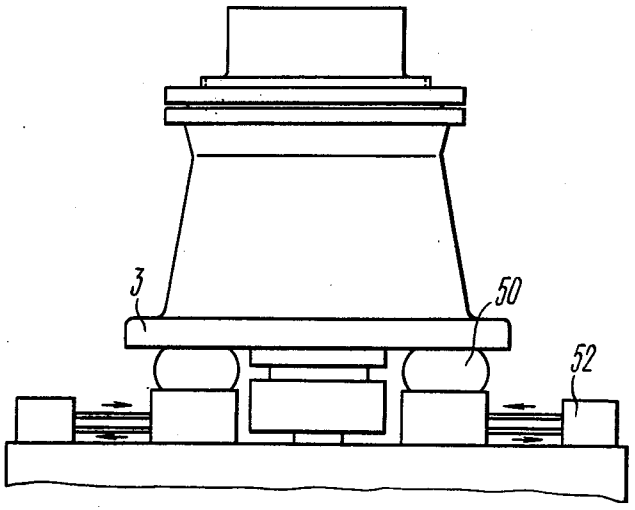
FIG. 8 shows the replenishment means for the additional feeding of the pneumatic balloons represented in FIG. 7.

In the embodiment shown in FIG. 8 the pneumatic balloons 50 are provided with a replenishment means 52 used to additionally feed them.

Figure 9:
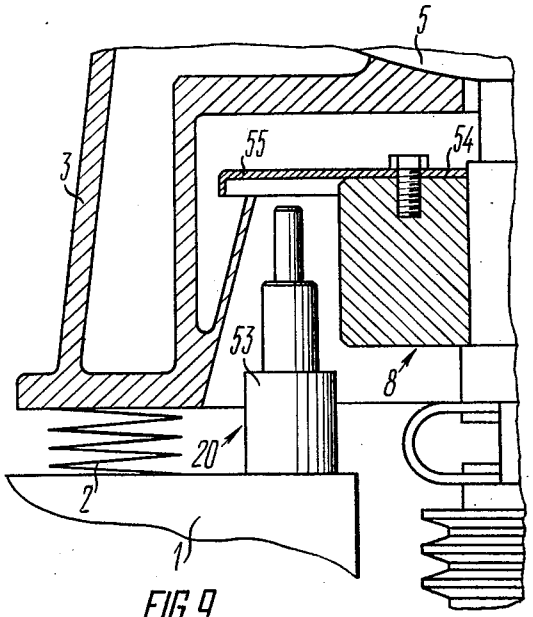
FIG. 9 shows an embodiment of the means for lifting and fixing the out-of-balance unit, made in form of lifting jacks.

Referring to FIG. 9, the embodiment of the means 20 for lifting and fixing the out-of-balance unit 8 is made as lifting jacks 53 installed on the base 1 of the shell 3. An oil deflecting ring 55 is mounted on a top portion 54 of the out-of-balance unit 8.

Figure 10:
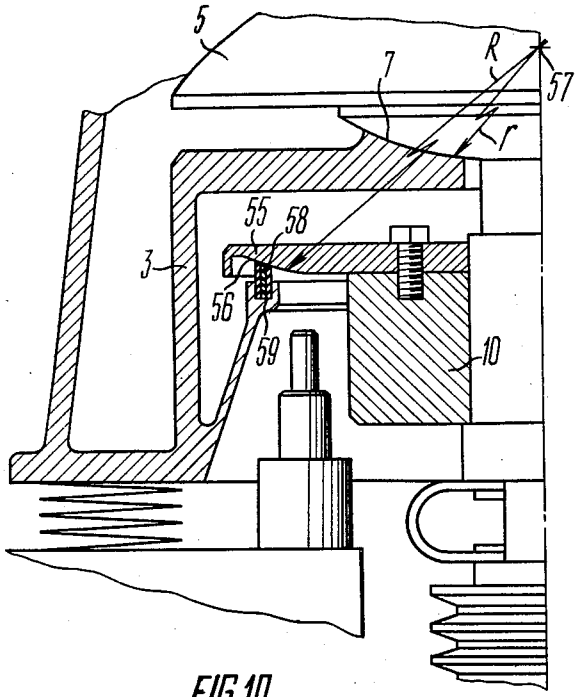
FIG. 10 shows one of modifications of the embodiment shown in FIG. 9.

In the embodiment illustrated in FIG. 10, the oil deflecting ring 55 has a spherical lower surface 56 on that portion which projects beyond the out-of-balance weight 10. The center of the spherical surface 56 coincides with a center 57 of the spherical support 7 of the breaking head 5 and is provided with an end-face seal 58 in an annular groove 59 of the shell 3, concentric with the crusher axis.

Figure 11:
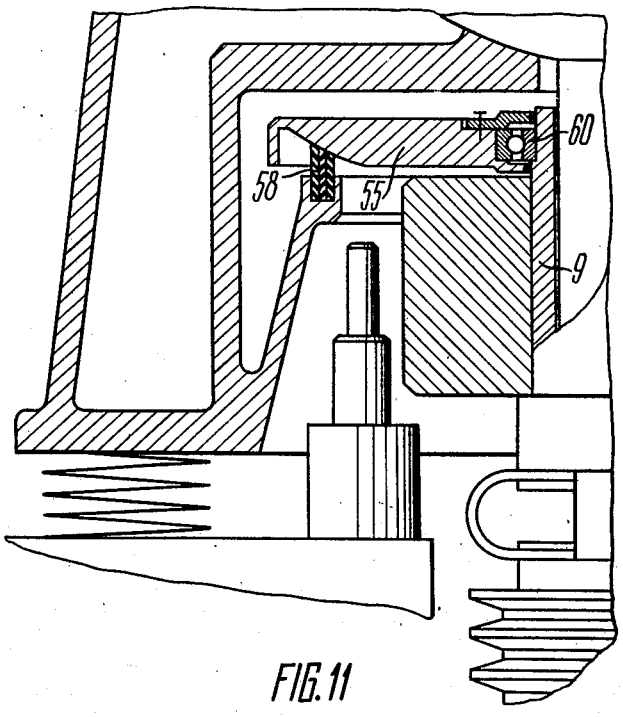
FIG. 11 shows one of modifications of the construction of FIG. 10.

Referring to FIG. 11, the oil defecting ring 55 is mounted on the bearing bush 9 by means of a bearing 60.

The inertia cone crusher made in accordance with the present invention operates in the following manner.

When the out-of-balance unit 8 (FIG. 1) is rotating, a centrifugal force circulating over the circle is generated and is transferred through the bearing bush 9 to the shaft 6 and to the breaking head 5 that starts precessing with respect to the spherical support 7. The ore fed into the annular space between the crushing bowl 4 and the breaking head 5 is crushed in the region of their approach.

When the working surface of the breaking head 5 is worn, the breaking head 5 is removed from the crusher for restoration. The dismantling of the breaking head 5 is performed in the following manner.

The out-of-balance unit 8 is lifted by turning the screws of the means 20, which press against the carrier disc 11, thus taking up the mounting clearance 18 (FIG. 2) and bearing the upper end 15 of the rod 12 against the end face 19 of the bore 17. This is accompanied by a compression of the compensation seal 29 within the limits of its elastic deformation, and the tension in the wedge joint of the bearing bush 9 and the lower end 13 of the rod 12 is relieved. The out-of-balance unit 8 is fixed in this position with the aid of the means 20 (FIG. 1). Then the wedge 25 (FIG. 2) is readily removed from the slot 26, and the breaking head 5 (FIG. 1) is dismantled.

The re-installation of the breaking head 5 is performed in the reverse order. Owing to the fact that during the dismantling of the breaking head 5 the out-of-balance unit 8 is fixed so that its bearing bush 9 has a negligible deviation from the coaxial arrangement with the shell 3, the shaft 6 readily enters the bearing bush 9, bearing against the upper end 15 of the rod 12 by the end face 19 of the bore 17. The compensation seal 29 (FIG. 2) is deformed, and the wedge 25 is readily installed into the slot 26. The screws of the means 20 (FIG. 1) are loosened, and a tension is developed in the wedge joint that takes up the axial load of the mass of the out-of-balance unit 8. As the out-of-balance unit 8 is rotating, an additional tension is produced in said wedge joint owing to the displacement of the center 31 of gravity (FIG. 2) of the wedge 25 with respect to the axis of rotation in the direction of its penetrating portion 32, preventing fall-out of the wedge 25 and loosening of the joint due to the action of the centrifugal force.

When the embodiment shown in FIG. 3 is used, a more reliable installation of the lower end 13 of the rod 12 into the central hole 23 of the bottom 24 of the bearing bush 9 is provided as the breaking head (not shown) is mounted. Furthermore, the fixation of the carrier ring 35 inside the bore 17 allows the installation height of the crusher to be reduced and the assembling of the end thrust bearing 34 to be simplified.

Figure 5:
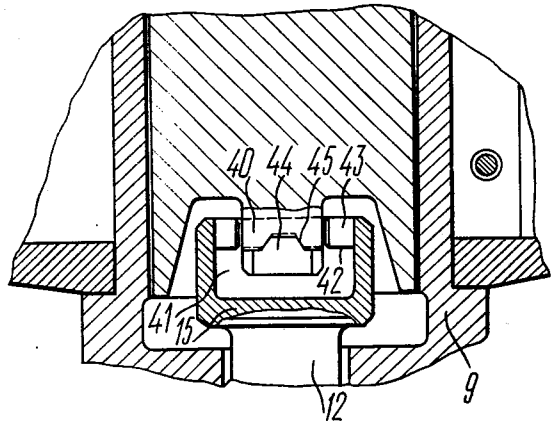
FIG. 5 is a sectional view of the embodiment shown in FIG. 4 as taken along the line V—V.

When the embodiment shown in FIGS. 4 and 5 is used, the dismantling of the breaking head (not shown) is performed as follows. When the out-of-balance unit 8 is fixed in the upper position the T-shaped end 44 of the gripper 40 leaves the groove 45, the breaking head is lifted by a crane (not shown) to a minimum height providing its separation from the spherical support 7 and is turned around its axis through 90°. The lower portion 44 of the gripper 40 becomes aligned with the slit 43. This allows the breaking head to be withdrawn from the crusher. The re-installation of the breaking head 5 is performed in the reverse order.

The embodiment of the means 20 shown in FIG. 6 allows a portable lever or other mechanical elevators to be used in order to speed up and to simplify lifting and fixing of the out-of-balance unit 8 as compared with the screw jacks mounted within the shell 3. The uniform distribution of the pushers 46 along the circumference concentric with the crusher axis provides a substantially vertical lifting of the out-of-balance unit 8.

If the shock-absorbers 2 of the shell 3 are the pneumatic balloons 50 (FIG. 7), lifting and fixing of the out-of-balance unit 8 are performed by setting the shell 3, releasing air from the pneumatic balloons 50. In this case the pushers 46 bear against the struts 51 of the base 1 and are displaced upwards with respect to the shell 3 until the shell 3 touches the surface of the base 1. The length of the pushers 46 is selected with due regard to lifting of the out-of-balance unit 8 within the mounting clearance 18 and the complete setting of the pneumatic balloons 50.

If the replenishment means 52 (FIG. 8) is used mounting of the breaking head (not shown) is carried out with lower labor input owing to simultaneous lifting of the shell 3 and lowering of the out-of-balance unit 8 by means of the pneumatic balloons 50 with the aid of air without use of manual labor to supply air thereinto. Furthermore, such a supply of additional air compensates possible air leakages from the penumatic balloons when the crusher operates.

If the means 20 for lifting and fixing the out-of-balance unit 8 is the lifting jacks 53 (FIG. 9) installed on the base 1 of the shell 3, mounting and the dismantling of the breaking head 5 are carried out by simultaneous supply of the working fluid into the lifting jacks or by its discharge therefrom.

The out-of-balance unit 8 is fixed in the upper position by locking the working fluid in the lifting jacks 53. The use of the lifting jacks partially arranged inside the shell 3 allows the lowering of the installation height of the crusher due to the installation of oil deflecting ring 55 in the upper portion 54 of the out-of-balance unit 8. This provides more easy access to the lower end 13 of the rod 12 (FIG. 3) for disconnection of the breaking head 5 from the out-of-balance unit or its connection thereto.

If the circumferential lower surface 56 (FIG. 10) of the oil deflecting ring 55 is made spherical and is in contact with the end-face seal 58, oil leakage from the casing (not shown) of the crusher and dust ingress thereinto are both avoided. The contact of the oil deflecting ring 55 with the end-face seal 58 over a sphere provides their relative displacement without any clearance.

If the oil deflecting ring 55 is connected with the bearing bush 9 by means of the bearing 60 (FIG. 11), the rotation of the oil deflecting ring 55 with respect to the end-face packing 58 is avoided. This substantially increases the life of the seal.

The proposed inertia cone crusher made in accordance with the present invention:

reduces the labor input for installing and dismantling the breaking head;

prevents waste of time in mounting and dismantling of the breaking head;

simplifies the construction of the crusher;

improves the reliabiity of the crusher;

reduces the installation height of the crusher.

While particular embodiments of the invention have been shown and described, various modifications thereof will be apparent to those skilled in the art and therefore it is not intended that the invention be limited to the disclosed embodiments or to the details thereof and the departures may be made therefrom within the spirit and scope of the invention as defined in the claims.

What is claimed is:

1. An inertia cone crusher comprising:

a shell installed on a base;

a crushing bowl fastened to said shell;

a breaking head resting on a spherical support formed in an upper portion of said shell, said breaking head having a shaft depending therefrom, said shaft having a bore in its shank;

elastic shock-absorbers intalled between said shell and said base of said shell;

an out-of-balance unit comprising:

a bearing bush installed about the shaft of said breaking head;

an out-of-balance weight fastened to said bearing bush;

a carrier disc arranged under said out-of-balance weight;

a rod for mounting said out-of-balance unit to the shaft of said breaking head, said rod having an upper end and a lower end;

said lower end of said rod being installed on said bearing bush;

said upper end of said rod being installed in the bore of said shank with a clearance with respect to the end face of said bore permitting axial movement of said rod relative to said shaft; and means for lifting said out-of-balance unit relative to said shaft and fixing it in the upper position.

2. The inertia cone crusher according to claim 1, wherein said means for mounting said upper end of said rod comprises:

an annular shoulder located on said upper end of said rod and arranged in said shank of said shaft of said breaking head;

a self-aligning end thrust bearing arranged and fixed in the bore of said shank adapted to support said annular shoulder when the upper end of said rod is finished and said breaking head rests on said spherical support.

3. The inertia cone crusher according to claim 2, wherein said means for lifting said out-of-balance unit comprises pusher means located in said lower portion of said shell and arranged uniformly along a circumference concentric with the crusher axis.

4. The inertia cone crusher according to claim 3, wherein said elastic shock-absorbers comprise pneumatic balloons, the said crusher having struts ararnged under said pusher means on said base adapted so that said pusher means would bear against said struts when said shell is set on said pneumatic balloons.

5. The inertia cone crusher according to claim 4, wherein said pneumatic baloons are provided with replenishment means.

6. The inertia cone crusher according to claim 2, wherein said means for lifting said out-of-balance unit comprises lifting jacks installed on said base, and a horizontal oil deflecting ring is located on an upper portion of said out-of-balance unit projecting radially outward.

7. The inertia cone crusher according to claim 6, wherein the lower surface of said oil reflecting ring is spherical and has a center coinciding with the center of said spherical support of said breaking head, and, and end-face seal is arranged on said shell concentrical with the crusher axis in engagement with the lower surface of said oil deflecting ring.

8. The inertia cone crusher according to claim 7, wherein said oil deflecting ring is mounted on said bearing bush by means of a bearing.

9. The inertia cone crusher according to claim 1, wherein said means for mounting said upper end of said rod comprises:

a T-shaped gripper located in said bore of said shank of said shaft;

a slot formed in said upper end of said rod, corresponding to said T-shaped gripper adapted to articulate with said T-shaped gripper when said upper end of said rod is mounted on said breaking head.

10. The inertia cone crusher according to claim 9, wherein said means for lifting said out-of-balance unit comprises pusher means located in said lower portion of said shell and arranged uniformly along a circumference concentric with the crusher axis.

11. The inertia cone crusher according to claim 10, wherein said elastic shock-absorbers comprise pneumatic balloons, said crusher having struts arranged under said pusher means on said base adapted so that said pusher means would bear against said struts when said shell is set on said pneumatic balloons.

12. The inertia cone crusher according to claim 11, wherein said pneumatic balloons are provided with replenishment means.

13. The inertia cone crusher according to claim 9, wherein said means for hoisting said out-of-balance unit comprises lifting jacks installed on said base, and horizontal oil deflecting ring is located on an upper portion of said out-of-balance unit projecting radially outward.

14. The inertia cone crusher according to claim 13, wherein the lower surface of said oil deflecting ring is spherical and has a center coinciding with the center of said spherical support of said breaking head, and an end-face seal is arranged on said shell concentrical with the crusher axis in engagement with the lower surface of said oil deflecting ring.

15. The inertia cone crusher according to claim 14, wherein said oil deflecting ring is mounted on said bearing bush by means of a bearing.

16. The inertia cone crusher according to claim 1, wherein said means for lifting said out-of-balance unit comprises pusher means located in a lower portion of said shell and arranged uniformly along a circumference concentric with the crusher axis.

17. The inertia cone crusher according to claim 16, wherein said elastic shock-absorbers comprise pneumatic balloons, said crusher having struts arranged under said pusher means on said base adapted so that said pusher means would bear against said struts when said shell is set on said pneumatic balloons.

18. The inertia cone crusher according to claim 17, wherein said pneumatic balloons are provided with replenishment means.

19. The inertia cone crusher according to claim 1, wherein said means for lifting said out-of-balance unit comprise lifting jacks installed on said base, and a horizontal oil deflecting ring is located on an upper portion of said out-of-balance unit projecting radially outward.

20. The inertia cone crusher according to claim 19, wherein the lower surface of said oil deflecting ring is spherical and has a center coinciding with the center of said spherical support of said breaking head and an end-face seal is arranged on said shell concentrical with the crusher axis in engagement with the lower surface of said oil deflecting ring.

21. The inertia cone crusher according to claim 20, wherein said oil deflecting ring is mounted on said bearing bush by means of a bearing.

* * * * *